United States Patent [19]

Honegger

[11] Patent Number: 4,909,453

[45] Date of Patent: Mar. 20, 1990

[54] METHOD OF AND APPARATUS FOR PROCESSING FLAT PRODUCTS, ESPECIALLY PRINTED PRODUCTS, ARRIVING IN AN IMBRICATED FORMATION

[75] Inventor: Werner Honegger, Tann-Rüti, Switzerland

[73] Assignee: Ferag AG, Hinwil, Switzerland

[21] Appl. No.: 381,999

[22] Filed: Jul. 17, 1989

Related U.S. Application Data

[63] Continuation of Ser. No. 942,868, Dec. 17, 1986, abandoned, which is a continuation of Ser. No. 496,901, May 23, 1983, abandoned.

[30] Foreign Application Priority Data

Jun. 2, 1982 [CH] Switzerland ..... 3387/82

[51] Int. Cl.[4] ..... B65H 29/66

[52] U.S. Cl. ..... 242/59; 53/118

[58] Field of Search ..... 242/59, 55; 53/118, 53/430; 271/3, 3.1, 9, 184, 186, 187, 204, 207, 216, 225, 277; 198/347

[56] References Cited

U.S. PATENT DOCUMENTS

| | | | |
|---|---|---|---|
| 3,659,699 | 5/1972 | Donahue et al. | 271/76 X |
| 3,908,978 | 9/1975 | Stemmle | 270/58 |
| 4,010,945 | 3/1977 | Kistner | 271/151 |
| 4,214,743 | 7/1980 | Meier | 271/182 |
| 4,424,965 | 1/1984 | Faltin | 271/202 |
| 4,434,948 | 3/1984 | Feldkamper | 242/59 |
| 4,438,618 | 3/1984 | Honegger | 242/59 X |
| 4,494,359 | 1/1985 | Honegger | 53/118 |
| 4,526,362 | 7/1985 | Thierstein | 242/59 X |
| 4,604,851 | 8/1986 | Reist | 242/59 X |

FOREIGN PATENT DOCUMENTS

| | | | |
|---|---|---|---|
| 2544135 | 4/1977 | Fed. Rep. of Germany . | |
| 2806503 | 8/1979 | Fed. Rep. of Germany . | |
| 170 | 7/1981 | Japan . | |
| 530926 | 1/1973 | Switzerland . | |
| 623794 | 6/1981 | Switzerland . | |
| 343345 | 2/1931 | United Kingdom | 271/184 |
| 2024176 | 1/1980 | United Kingdom . | |
| 2081230 | 2/1982 | United Kingdom . | |
| 2092557 | 8/1982 | United Kingdom | 242/59 |

*Primary Examiner*—John M. Jillions

*Attorney, Agent, or Firm*—Fleit, Jacobson, Cohn, Price, Holman & Stern

[57] ABSTRACT

The printed products are fed in an imbricated formation by a transport apparatus to a wind-up station. By opening gripper units of the transport apparatus the printed products are released and drop onto a conveyor belt, the conveying direction of which is opposite to the conveying direction of the transport apparatus. The imbricated formation formed on the conveyor belt passes through a deflector or turning device in which the imbricated formation is deflected or turned by approximately 180° about the rotational axis of a deflecting drum. The imbricated formation leaving the deflector or turning device is inputted from below to a winding core and wound-up thereon for intermediate storage. For further processing the wound-up imbricated formation is unwound and removed in a direction which is opposite to the wind-up direction. The printed products in the removed imbricated formation have the same relative position as in the arriving imbricated formation with the exception that the top side of the printed products as present in the arriving imbricated formation is now located on the bottom side.

30 Claims, 3 Drawing Sheets

METHOD OF AND APPARATUS FOR PROCESSING FLAT PRODUCTS, ESPECIALLY PRINTED PRODUCTS, ARRIVING IN AN IMBRICATED FORMATION

CROSS-REFERENCES TO RELATED APPLICATIONS

This application is a continuation of application Ser. No. 06/942,868, filed Dec. 17, 1986, abandoned, which is a continuation application of my commonly assigned U.S. application Ser. No. 06/496,901, filed May 23, 1983, and entitled: "Method of and Apparatus for Processing Flat Products, Especially Printed Products, Arriving in an Imbricated Formation", now abandoned. This application is also related to (i) the commonly assigned, copending U.S. application Ser. No. 06/280,998, filed July 6, 1981, entitled "Apparatus for Stacking Printed Products, such as Newspapers, Periodicals and the Like, Arriving in an Imbricated Product Stream", now U.S. Pat. No. 4,438,618, granted Mar. 27, 1984; (ii) the commonly assigned, copending U.S. application Ser. No. 06/338,568, filed Jan. 11, 1982, entitled "Method and Apparatus for the Long-Term Pressing of Printed Products, Especially Newspapers", now U.S. Pat. No. 4,494,359, granted Jan. 22, 1985; (iii) the commonly assigned, copending U.S. application Ser. No. 06/432,557, filed Oct. 4, 1982, entitled "Apparatus for the Storage of Flat Products Arriving in an Imbricated Formation, Especially Printed Products", now U.S. Pat. No. 4,587,790, granted May 13, 1986; (iv) the commonly assigned, copending U.S. application Ser. No. 06/445,564, filed Nov. 29, 1982, entitled "Method of, and Apparatus for, Removing Flat Products, Especially Printed Products, From a Winding Core", now U.S. Pat. No. 4,525,482 granted July 2, 1985; and (v) the commonly assigned, copending U.S. application Ser. No. 06/445,565, filed Nov. 29, 1982, entitled "Method and Apparatus for Storing Continuously Arriving Flat Products, Especially Printed Products, and Product Package Formed from such Products", now U.S. Pat. No. 4,575,988, granted Mar. 18, 1986; and (vi) the commonly assigned, copending U.S. application Ser. No. 06/497,142, filed May 23, 1983, entitled "Method of, and Apparatus for, Processing Flat Products, Especially Folded Printed Products, Arriving in an Imbricated Formation".

BACKGROUND OF THE INVENTION

The present invention broadly relates to a new and improved method of, and apparatus for, processing flat products, especially printed products, arriving in an imbricated product formation.

In its more specific aspects, the invention relates particularly to a new and improved method of, and apparatus for, processing flat products, especially printed products, arriving in an imbricated formation in which the products are wound-up to form a product package for storing the same and in which the products are again unwound from the product package for further processing.

At times throughout this disclosure reference to such method and apparatus will simply generally be made in terms of measures for accomplishing such processing. Equally, while the description to follow, as a matter of convenience, refers to the processing of printed products, obviously other types of products can be conveniently handled, and therefore, the use of this term is not to be construed in a limiting sense in any way whatsoever, but merely is to be viewed as an exemplary and desirable field of application for the inventive measures.

For the intermediate storage of printed products arriving in an imbricated formation it is known, for example, from German Patent Publication No. 3,123,888 and the cognate British Patent Publication No. 2,081,230 to wind-up the imbricated product formation upon a winding core. For removing the printed products from the stored product package the imbricated formation is again unwound in a direction opposite to the wind-up direction.

However, the printed products assume a position in the unwound imbricated stream which is different from that in the arriving imbricated stream. The edge of the arriving imbricated printed products which lies on top and forms the leading edge in the latter, while still lying on top after the unwinding operation now forms the trailing edge. Such a changed product position, however, in most cases is undesirable for further processing.

SUMMARY OF THE INVENTION

Therefore, with the foregoing in mind it is a primary object of the present invention to provide a new and improved method of, and apparatus for, processing flat products, especially printed products, arriving in an imbricated formation in which the products, after storage in the form of a wound product package are supplied for further processing in such a manner that the leading edge is formed by the same product edge and has the same position within the imbricated product formation as in the originally arriving imbricated product stream in which the leading edge, for example, lies on top.

Another important object of the present invention is directed to the provision of a new and improved method of, and apparatus for, processing flat products, especially printed products, arriving in an imbricated formation which enables the aforementioned positioning of the leading edge of the printed products after unwinding from the stored product package to be realized in as simple and efficient manner as possible.

Now in order to implement these and still further objects of the invention, which will become more readily apparent as the description proceeds, the method of the present development is manifested by the features that, the individual products within the arriving imbricated formation are placed into a different position corresponding to a rotation by approximately 180° about an axis extending substantially parallel to the plane of the product either prior to winding-up or after unwinding the same, and the imbricated formation, either prior to winding-up or after unwinding the same, is inverted such that the top side of the imbricated formation is positioned at the bottom.

By changing the position of the individual products within the imbricated formation and by inverting the latter it is ensured that the products are arranged in the imbricated structure for further processing in such a way that the same edge of each product forms the leading edge, and that each product assumes the same position relative to the adjacent products, as in the arriving imbricated formation. This means that in the case of an arriving imbricated formation in which each product rests upon the preceding product such that the leading edge of the products is positioned on the top side, that also in the imbricated formation to be supplied for further processing, after intermediate storage thereof, each product rests upon the preceding product, and additionally, the same edge of the products like, for example, the fold edge forms a leading edge positioned on the top side in the same manner as in the arriving imbricated formation.

As alluded to above, the invention is not only concerned with the aforementioned method aspects, but also relates to a novel construction of apparatus for the performance thereof. Generally speaking, the inventive apparatus comprises a wind-up station for winding-up the products to form a product package and/or an unwinding station for unwinding the products from the product package, means for placing the individual products within the imbricated formation into a different position corresponding to a rotation through approximately 180° about an axis extending substantially parallel to the plane of the product, which placing means may be arranged either forwardly or upstream of the wind-up station, i.e. at a location where each product has not yet reached the wind-up station, or after or downstream of the unwinding station, i.e. at a location where each product has already passed through the unwinding station, and means for inverting the imbricated formation such that the top side of the imbricated formation is positioned at the bottom, and which inverting means are arranged either forwardly or upstream of the wind-up station, i.e. at a location where each product has not yet reached the wind-up station, or after or rearwardly of, i.e. downstream of, the unwinding station, i.e. at a location where each product has already passed through the unwinding station.

Simple structural means can be beneficially employed to perform the positional change of the products and to invert the imbricated formation.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
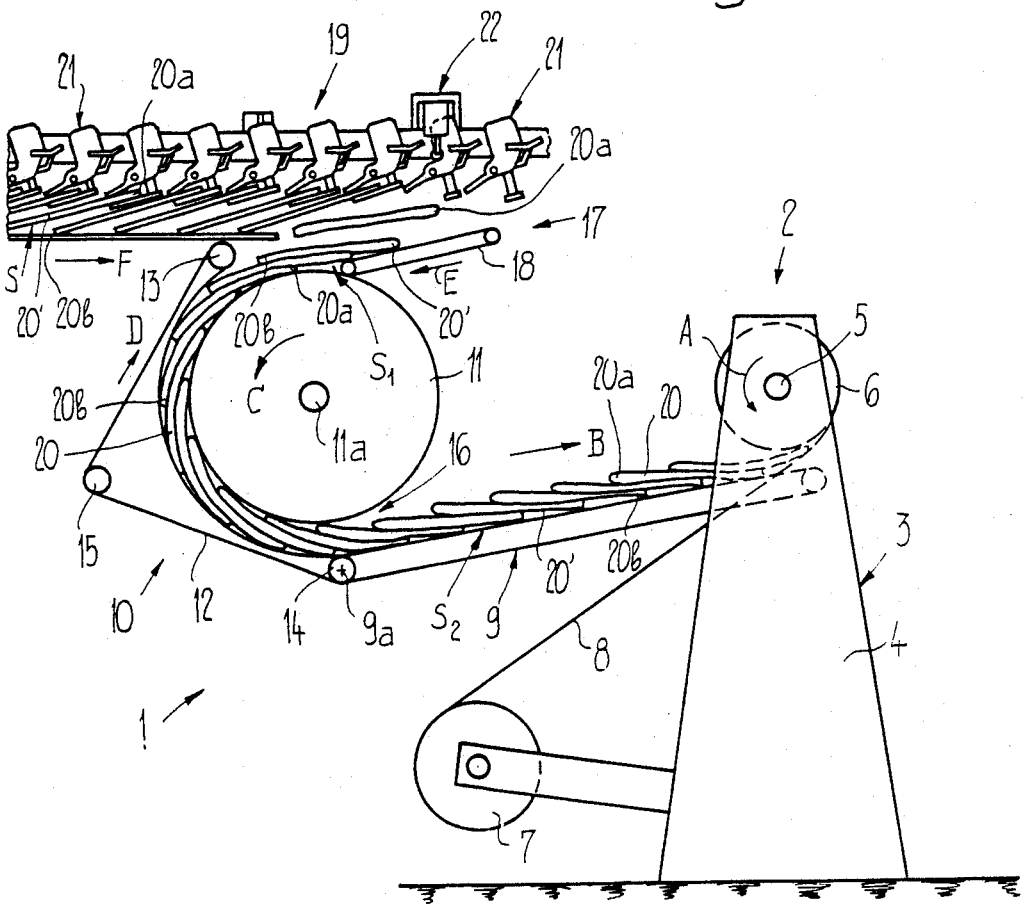
FIG. 1 is a schematic side view of a first embodiment of apparatus constructed according to the invention in which a wind-up station is placed rearwardly of or subsequent to the means for inverting the imbricated formation, i.e. at a location where each product has already passed through the inverting means.

Describing now the drawings, it is to be understood that only enough of the construction of the apparatus for processing flat products or the like has been shown as needed for those skilled in the art to readily understand the underlying principles and concepts of the present development, while simplifying the showing of the drawings. Turning attention now specifically to FIG. 1, there has been schematically illustrated therein a wind-up station 1 of a first exemplary embodiment of apparatus constructed according to the present invention. The wind-up station 1 comprises a wind-up location or position 2, at which a wind-up and storage unit 3 is located. Such a wind-up and storage unit 3 is described in greater detail in German Patent Publication No. 3,236,866 and the cognate British Patent Publication No. 2,107,681. Reference is therefore made thereto for a more detailed description of the structure and of the mode of operation of such wind-up and storage unit 3, although the same will be sufficiently considered herein in order to furnish adequate understanding thereof so as to enable those skilled in the art to fully appreciate the present invention.

The wind-up and storage unit 3 comprises a mobile frame or frame unit 4 which has the form of a bearing block or pedestal or equivalent structure. The shaft 5 of a substantially cylindrical winding core 6 is rotatably journalled or mounted in the frame 4. The winding core 6 is appropriately drivable in the direction of the arrow A in a manner which is not here shown in more detail. Furthermore, a band spool 7 containing a winding band or tape 8 is rotatably journalled in the frame 4. This winding band or tape 8 is composed of a tension-resistant material like, for example, plastics material, and one end thereof is fixedly connected to the winding core 6. Upon rotating the winding core 6 the winding band or tape 8 is withdrawn from the band spool 7 and any suitable braking means (not shown) are provided in order to maintain the winding band or tape 8 under tension as it is wound-up upon the winding core 6. The wind-up and storage unit 3 is followed by a rocker-like belt or band conveyor 9 which extends below the winding core 6 and which is pivotable about an axis 9*a*. This belt or band conveyor 9 is urged towards the winding core 6 or, respectively, towards the product package formed thereon in any appropriate manner. The conveying direction of the belt or band conveyor 9 is indicated by the arrow B.

As seen in the conveying direction B a deflector or turning device 10 is arranged forwardly of the belt or band conveyor 9, i.e. at a location where each product has not yet reached the belt or band conveyor 9. The deflector or turning device 10 comprises a rotatable deflecting drum or shaft 11 rotatable about its axis 11*a* in the direction of the arrow C and driven in any suitable manner not here shown in greater detail. One run or strand of an endless support or carrier band 12 extends along a part of the circumference of the deflecting drum 11 and at a distance therefrom. The support band 12 is deflected or guided by three guiding rollers 13, 14, 15 and is appropriately driven to revolve in the direction of the arrow D. The run or strand of the support band 12 which is positioned between the deflection or guiding rollers 13 and 14 together with the deflecting drum 11 defines a conveying gap or space 16.

A position changing means for changing the position of the printed products is generally designated by reference numeral 17 and is arranged forwardly or upstream of the deflector or turning device 10, i.e. at a location where each product has not yet reached the deflector or turning device 10; the mode of operation thereof will be described hereinafter. The position changing means 17 comprises a belt or band conveyor 18 possessing a predetermined conveying direction E. The belt or band conveyor 18 is placed below a transport apparatus 19 and extends transversely with respect to the conveying direction F of the latter. The belt or band conveyor 18 thus is positioned at an angle or inclination relative to the travel path or path of movement of the printed products 20 delivered or infed by the transport apparatus 19.

The transport apparatus 19 is of known design and, for instance, corresponds to the transport apparatus as known, for example, from U.S. Pat. No. 3,955,667 with respect to its structure and function. As seen in the conveying direction F, the transport apparatus 19 comprises series or tandemly arranged gripper units or grippers 21 which retain the printed products 20 at the region of their leading edge 20*a* which is formed by a fold of the product. Releasing means 22 are arranged above the belt or band conveyor 18 and are designed to open the gripper units 21 passing the same in order to release the printed products 20 supplied thereby.

The mode of operation of the wind-up apparatus as described hereinbefore is as follows:

The transport apparatus 19 conveys the arriving or inbound printed products 20 in an imbricated formation S from a suitable source which, for example, may be constituted by a rotary printing press to the wind-up station 1. The position of the printed products 20 within the imbricated product formation S is such that each printed product 20 rests upon the respective preceding printed product. The leading edge 20*a* of each printed product 20, which in the presently illustrated case is the fold edge, thus lies on top. As already mentioned, the printed products 20 are retained by the successively arranged gripper units or grippers 21 at the leading product edge 20*a*. The top side or upper surface of the printed products 20 supplied by the transport apparatus 19 is designated by reference numeral 20'. Upon passing the releasing means or releasing device 22 each gripper unit or gripper 21 is opened. As a consequence thereof, the printed product 20 is released and drops down onto the belt or band conveyor 18 arranged therebelow or, respectively, onto the previously released printed product. This belt or band conveyor 18, as already mentioned, possesses a predetermined conveying direction E which is opposite to the conveying direction F of the transport apparatus 19. By placing the printed products 20 upon the belt or band conveyor 18 an imbricated product stream $S_1$ is formed thereon in which the printed products 20 assume a position which is different from that in the arriving imbricated product stream S. While, as before, each printed product 20 rests on the neighboring preceding printed product in the imbricated stream $S_1$, the leading edge, however, is no longer formed by the fold edge 20*a* but by the edge 20*b* which was the trailing edge in the arriving imbricated stream S. The printed products 20 thus assume a new position in the imbricated stream $S_1$ formed upon the belt or band conveyor 18.

The imbricated formation $S_1$ reaches the conveying gap or space 16 of the deflector or turning device 10 when conveyed by the belt or band conveyor 18. In the deflector or turning device 10 the imbricated stream $S_1$ is turned over or inverted about the rotational axis 11*a* of the deflecting drum 11 by an angle substantially amounting to 180°. The imbricated stream $S_2$ which leaves the conveying gap 16 and which is taken over by the belt or band conveyor 9 possesses a conveying direction B which is opposite to the supplying or infeed direction E of the imbricated stream $S_1$. In the imbricated stream $S_2$ leaving the deflector or turning device 10 and supplied to the winding core 6 by the belt or band conveyor 9, each printed product 20 now rests upon the respective successive or trailing printed product. This means that now the leading edge 20*b* is at the bottom and that the exposed or free edge 20*a* forms the trailing edge. The side 20' which was the top side in the arriving imbricated stream S now is on the bottom side or underside of the imbricated stream $S_2$. The imbricated stream $S_2$ is input from below to the winding core 7 and is wound-up thereon with the winding band or tape 8 simultaneously being wound-up between the layers or plies of the product package. After the product package has been formed the same is exchanged for another empty wind-up and storage unit 3.

Figure 2:
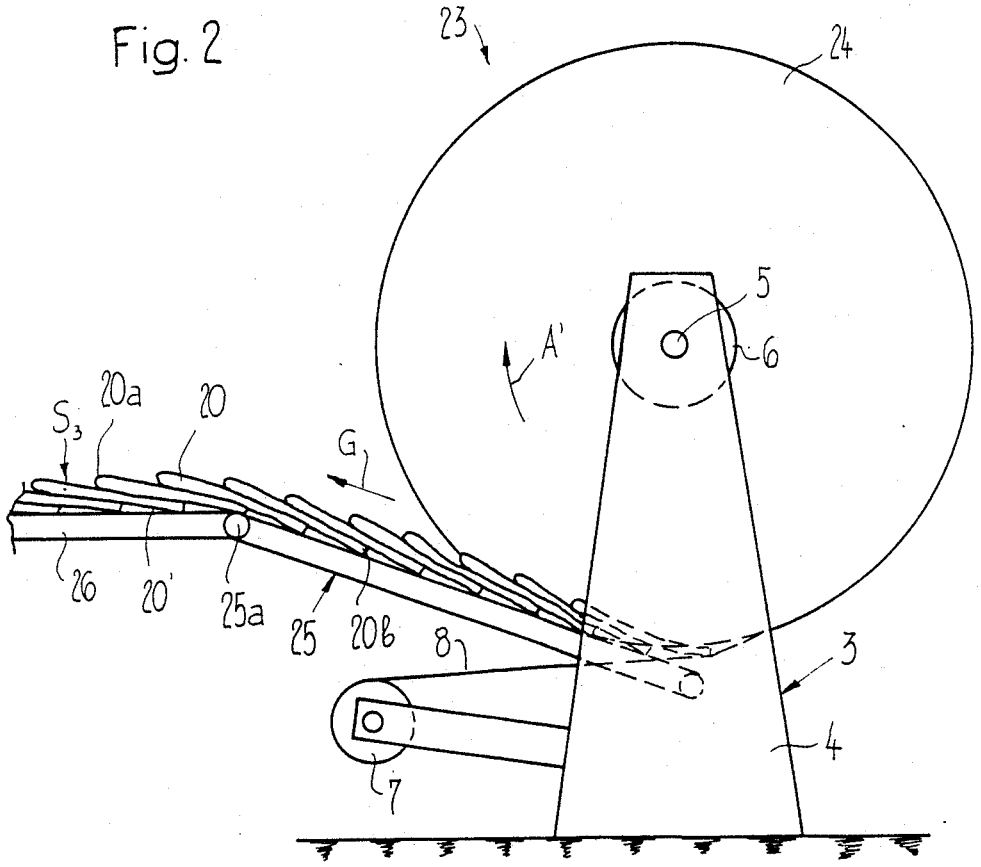
FIG. 2 is a schematic side view of the unwinding station of the apparatus shown in FIG. 1.

When the printed products 20 wound-up on the winding core 6 are required for further processing, then the wind-up and storage unit 3 is moved to an unwinding station 23 as shown in FIG. 2 where the printed products are removed from the product package 24. As will be evident from FIG. 2, a belt or band conveyor 25 designed as a rocker or balance structure is present at the unwinding station 23 and is pivotable about its pivot axis or shaft 25*a*. This rocker-like belt or band conveyor 25 corresponds to the belt or band conveyor 9 provided at the wind-up station 1 shown in FIG. 1 and is pressed against the package 24 of printed products by any suitable means not here further shown. A further belt or band conveyor 26 follows the belt or band conveyor 25 and has substantially the same conveying direction G as the belt or band conveyor 25.

The imbricated product formation stored in the form of a wound product package on the winding core 6 is unwound therefrom in a manner known as such by winding-up the winding band or tape 8 onto the band spool 7, with the consequence that the winding core 6 is rotated in the direction of the arrow A'. The unwound imbricated product stream $S_3$ is supplied to any suitable further processing station (not shown) by the belt or band conveyor 26 and now corresponds substantially to the original imbricated product formation S. In the imbricated formation $S_3$ each printed product 20, also, rests upon the respective preceding printed product 20 and the leading edge of each printed product 20 is also formed by the fold edge 20*a*. On the other hand, the side or face 20' of the printed products 20 which was the top side or face in the arriving imbricated stream S is now positioned at the bottom side or bottom of the imbricated formation $S_3$. In very many cases, however, this is of no consequence for the further processing of the products for which it is, however, significant that the leading edge be placed on top and be formed by the fold edge 20*a* as in the arriving imbricated stream S.

Figure 3:
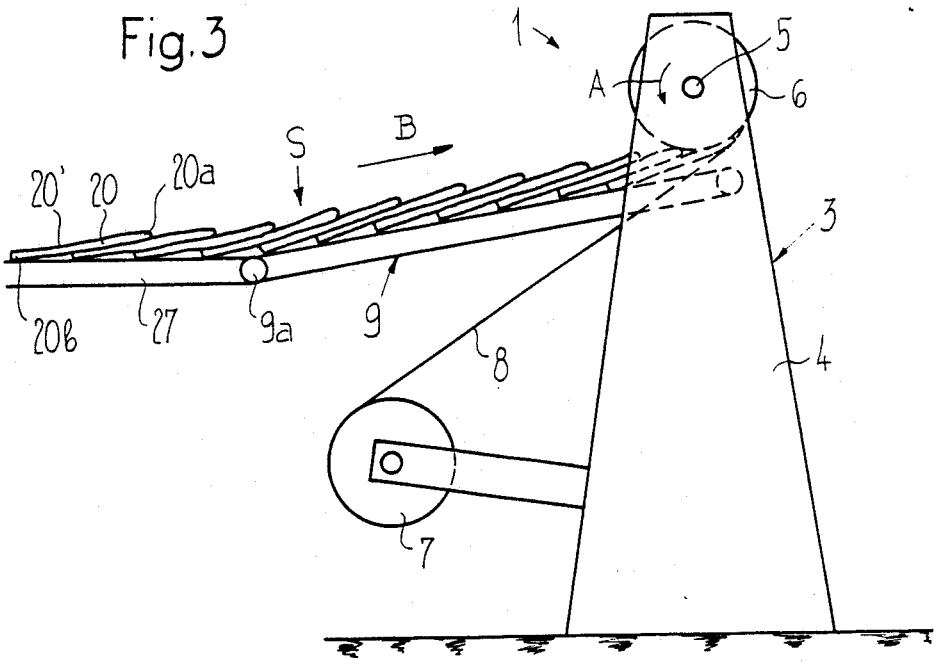
FIG. 3 is a schematic side view of the wind-up station of a second embodiment of the apparatus constructed according to the invention.
Figure 4:
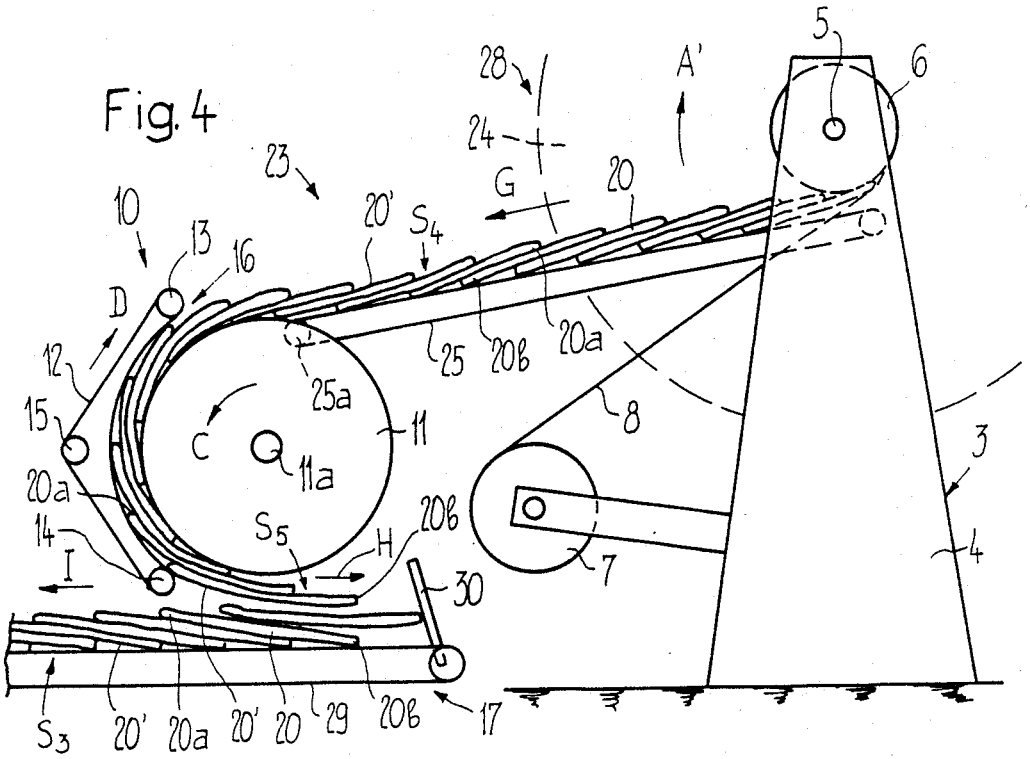
FIG. 4 is a schematic side view of an unwinding station placed forwardly or upstream of the means for inverting the imbricated product formation, i.e. at a location where each product has not yet reached the inventive means.

In the embodiment described hereinbefore the change in the position of the printed products 20 within the imbricated structure as well as the inversion of the imbricated formation occurs prior to the winding-up operation performed at the wind-up station 1. Now it is also possible to carry out the inversion of the imbricated stream and the change in the position of the printed products following the unwinding of the imbricated formation from the product package. A second embodiment of the apparatus according to the invention suitable for the performance thereof is illustrated in FIGS. 3 and 4. Components or parts shown in FIGS. 3 and 4 which essentially correspond to components or parts of the apparatus shown in FIGS. 1 and 2 have been therefore conveniently generally designated by the same reference numerals as used in connection with the first considered embodiment of FIGS. 1 and 2.

The wind-up station 1 shown in FIG. 3 includes a belt or band conveyor 27 arranged forwardly of the belt or band conveyor 9 designed as a rocker, i.e. at a location where each product has not yet reached the belt or band conveyor 9, and supplies the imbricated formation S arriving from a suitable source like, for example, a rotary printing press to the wind-up station 1. In its structure the imbricated formation S corresponds to the imbricated formation S shown in FIG. 1. The imbricated formation S supplied by the belt or band conveyor 27 is wound-up upon the winding core 6 without any change.

In FIG. 4 there is now shown the unwinding station 23 which is similar with respect to its structure and function to the wind-up station 1 shown in FIG. 1. The frame 4 including the wound product package 24 is located at an unwinding location or position 28. In the same manner as in the embodiment shown in FIG. 2, a rocker-like belt or band conveyor 25 possessing a conveying direction G is located below the winding core 6 or, respectively, the product package 24. A deflecting device or means 10 follows the belt or band conveyor 25 and corresponds to the deflector or turning device 10 shown in FIG. 1. A belt or band conveyor 29 possessing a conveying direction I and serving to remove or outfeed the printed products 20 is arranged below the deflector or turning device 10. An abutment means or stop 30 is arranged above the belt or band conveyor 29 and in the travel path or path of movement of the printed products 20 which leave the deflector or turning device 10. The abutment means 30 forms part of the means 17 for changing the position of the printed products 20 within the imbricated product formation.

The mode of operation of the apparatus shown in FIG. 4 is as follows:

Contrary to the original imbricated stream S each printed product 20 rests upon the respective successive printed product in the imbricated formation $S_4$ which is unwound from the winding core 6 and which is supplied to the deflector or turning device 10 in the conveying direction G. The original leading edge 20*a* now forms the trailing edge in the imbricated formation $S_4$ and lies on the top side thereof. At the deflecting device or means 10 the imbricated formation $S_4$ is deflected or turned about the rotational axis 11*a* of the deflecting drum 11 by approximately 180°. An imbricated product stream $S_5$ leaving the conveying gap or space 16 now has a direction of movement H which is opposite to the product infeed or supplying direction G. In the imbricated formation $S_5$ each printed product 20 now again rests upon the neighboring preceding printed product. However, the leading edge 20*b* is that edge which in the originally arriving imbricated formation S formed the trailing edge, as evident by inspecting FIG. 3. Additionally, that side or face 20' of the printed products is at the bottom in the imbricated stream $S_5$ which previously was located on the top side in the original imbricated formation S.

The printed products leaving the conveying gap or space 16 of the deflector or turning device 10 are now conveyed in the direction H towards the abutment means 30 and abut the same with their leading edge 20*b*. Thereafter the printed products 20 drop down onto the belt or band conveyor 29 or, respectively, onto the previously deposited printed product 20 placed thereon. There is thus formed an imbricated product formation $S_3$ on the belt or band conveyor 29 which corresponds in its structure to the imbricated formation $S_3$ removed by the belt or band conveyor 26 in the apparatus previously shown and described with reference to FIG. 2. By placing the individual printed products 20 on the belt or band conveyor 29, which possesses a conveying direction I opposite to the direction of movement of the printed products 20 leaving the deflector or turning device 10, the position of the printed products 20 within the imbricated formation is changed. In the same manner as described with reference to FIG. 1, this change in position corresponds to a rotation of the printed products 20 through an angle of about 180° about an axis extending parallel to the plane of the printed products 20.

As already explained with reference to FIG. 2, the printed products 20 in the imbricated formation $S_3$ assume the same position as they possessed within the original imbricated formation S with the exception that the side or face 20' which originally lay on top is now located on the bottom side or bottom of the imbricated formation $S_3$.

By using the apparatus as described hereinbefore it is possible to store the printed products by winding-up the same through the use of relatively simple means and to supply the same after such intermediate storage to a suitable processing station in a product formation as required for further processing.

In the following description some of the various possible modifications of the exemplary embodiments illustrated and described hereinbefore will be mentioned. Thus, it is possible, for example, to perform the change in the position of the printed products within the imbricated formation or, respectively, to invert the imbricated formation prior to the wind-up operation, while the inversion of the imbricated formation or, respectively, the change in the position of the printed products is performed after the unwinding operation. Contrary to the embodiments as shown and described hereinbefore, with this modification the inverntion of the imbricated stream and the change of the position of the printed products do not occur immediately in succession.

Inversion of the imbricated product formation by the illustrated deflector or turning device 10 permits a space-saving construction. However, it is also conceivable to invert the imbricated product formation in any other suitable way as, for example, by turning it through 180° about the longitudinal axis of the imbricated formation which extends in the conveying direction thereof, as shown and explained, for example, in U.S. Pat. No. 3,735,977 and the cognate Swiss Patent No. 530,926.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. In a method of processing flat products especially printed products, arriving in an arriving imbricated formation, wherein the imbricated products are wound up to form a product package for storage and are unwound from the product package to form an unwound imbricated formation for further processing, the improvement wherein the product configuration of the arriving imbricated formation, in terms of mutual positions of the individual products and positions of leading edges of the products viewed in a conveying direction of the arriving imbricated formation, is retained in the unwanted imbricated formation by the steps of:

changing the position of individual products of the flat products within one of said imbricated formations such that edges of said individual products which are leading become trailing; and inverting said one of the imbricated formations for turning the products upside down.

2. The method as defined in claim 1, wherein:

there is first performed the step of changing said position of said products within said imbricated formation and thereafter there is performed the step of inverting said imbricated formation.

3. The method as defined in claim 1, wherein:

there is first performed the step of inverting said imbricated formation and then there is performed the step of changing the position of said products therein.

4. The method as defined in claim 1, further including the step of:

consecutively changing the conveying direction of each individual product by 180° in order to change the position thereof.

5. The method as defined in claim 1, further including the steps of:

conveying the imbricated formation along a longitudinal axis thereof extending in a predetermined conveying direction; and performing the step of inverting said imbricated formation by turning-over the same about a transverse axis extending substantially horizontally and transversely relative to said longitudinal axis.

6. A method as claimed in claim 1 wherein the steps of changing the position of individual products and inverting said one of the imbricated formations are separated by the winding and unwinding steps.

7. A method of processing flat products, especially printed products, arriving in an imbricated product formation having a predetermined conveying direction, comprising the steps of:

changing the position of individual products within the imbricated product formation by at least reversing said predetermined conveying direction of said imbricated product formation such that edges of said individual products which are leading and uppermost become trailing in the reversed conveying direction and lowermost in the changed position and sides of said individual products which are uppermost remain uppermost;

inverting said imbricated products formation such that sides of said individual products which are uppermost become lowermost;

then winding up said individual products to form a product storage package and unwinding the package to form an unwound imbricated formation in which the mutual positions of the individual products and the positions of leading edges of the products viewed in a conveying direction are the same as in the arriving imbricated formation.

8. A method of processing flat products, especially printed products, arriving in an imbricated product formation having a predetermined conveying direction, comprising the steps of winding the imbricated formation into a package for storage, unwinding the imbricated formation and delivering the imbricated formation with each product resting upon a preceding product; wherein the method includes the further steps of:

inverting said imbricated product formation such that sides of said individual products which are uppermost become lowermost; and then changing the position of said individual products within the imbricated product formation such that edges of said individual products which are leading and uppermost become trailing and lowermost and sides of said individual products which are lowermost remain lowermost, said further steps being carried out prior to said delivering step.

9. A method of processing flat products, especially printed products, arriving in an imbricated formation, comprising the steps of:

winding-up the flat products to form a product package for storing the flat products;

unwinding the flat products from said product package;

subsequently inverting the imbricated formation for turning the imbricated formation upside down; and subsequently changing the position of individual products of the flat products within the imbricated formation such that edges of said individual products which are leading become trailing.

10. The method as defined in claim 9, further including the steps of:

conveying said products of the inverted imbricated formation such that each product rests upon a preceding product; and then changing the conveying direction of each individual product by 180° in order to change the position thereof.

11. The method as defined in claim 9, further including the steps of:

conveying the imbricated formation along a longitudinal axis thereof extending in a predetermined conveying direction; and performing the step of inverting said imbricated formation by turning-over the same about a transverse axis extending substantially horizontally and transversely relative to said longitudinal axis.

12. An apparatus for processing flat products, especially printed products, arriving in an imbricated formation, comprising:

position changing means for repositioning individual products of the flat products within the imbricated formation into a different position such that edges of said individual products which are leading become trailing;

inverting means arranged subsequent to said positioning means for receiving the imbricated formation from the position changing means and inverting the imbricated formation such that the imbricated formation is turned upside down; and a wind-up station for winding up the flat products to form a product package for storing the flat products and an unwinding station for unwinding the flat products from said product package to form an imbricated formation.

13. The apparatus as defined in claim 12, wherein:

said flat products move along a predetermined path of travel and possess a first conveying direction;

said position changing means including a conveyor arranged below said path of travel; and said conveyor defining a second conveying direction deviating from said first conveying direction.

14. The apparatus as defined in claim 13, wherein:

said second conveying direction runs opposite to said first conveying direction.

15. The apparatus as defined in claim 13, wherein:
said conveyor is arranged to form an angle with respect to said path of travel.

16. The apparatus as defined in claim 12, wherein:
said flat products moving along said path of travel each have a leading edge;
said position changing means including abutment means projecting into the path of travel of said printed products as they are supplied to said conveyor; and
said leading edges of said printed products abutting said abutment means.

17. The apparatus as defined in claim 12, wherein:
said imbricated formation defines a longitudinal axis extending in a predetermined conveying direction;
said inverting means comprise deflecting means defining a transverse axis and serving to deflect said imbricated formation about said transverse axis; and
said transverse axis extending substantially horizontally and transversely relative to said predetermined conveying direction.

18. The apparatus as defined in claim 17, wherein:
said deflecting means comprise a deflecting drum rotatable about said transverse axis and an endless revolving support band extending about the circumference of said deflecting drum at a distance therefrom in order to define together with said deflecting drum a conveying gap through which passes said imbricated formation; and
said imbricated formation entering said conveying gap in a first conveying direction and leaving said conveying gap in a second conveying direction extending opposite to said first conveying direction.

19. An apparatus for processing flat products, especially printed products, arriving in an imbricated formation having a predetermined conveying direction, comprising:
position changing means for repositioning the products within said imbricated formation into a different position corresponding to a reversal of imbrication of said products and for simultaneously reversing said predetermined conveying direction of said imbricated formation such that edges of said individual products which are leading and uppermost become trailing and lowermost and sides of said individual products which are uppermost remain uppermost;
inverting means arranged subsequent to said position changing means for receiving the imbricated formation from the position changing means and for inverting said imbricated formation such that sides of said individual products which are uppermost become lowermost; and
a wind-up station arranged subsequent to said inverting means for winding-up said products to form a product package for storing the same.

20. An apparatus for processing flat products, especially printed products, arriving in an imbricated formation, comprising:
position changing means for repositioning individual products of the flat products within the imbricated formation into a different position such that edges of said individual products which are leading become trailing;
inverting means arranged subsequent to said positioning means for receiving and inverting the imbricated formation such that the imbricated formation is turned upside down; and
a wind-up station for winding up the flat products to form a product package for storing the flat products.

21. An apparatus for processing printed products arriving in a imbricated formation, comprising:
a wind-up station for winding up the printed products to form a product package for storing the printed products and an unwinding station for unwinding the printed products from said product package to form an imbricated formation;
inverting means arranged subsequent to said unwinding station for receiving and inverting the imbricated formation such that the imbricated formation is turned upside down; and
position changing means arranged subsequent to said inverting means for receiving and repositioning individual products of the printed products within the imbricated formation into a different position such that edges of said individual products which are leading become trailing.

22. The apparatus as defined in claim 21, wherein:
said printed products move along a predetermined path of travel and following inverting of the imbricated formation by the inverting means possess a first conveying direction;
said position changing means including a conveyor arranged below said path of travel; and
said conveyor defining a second conveying direction deviating from said first conveying direction.

23. The apparatus as defined in claim 22, wherein:
said second conveying direction runs opposite to said first conveying direction.

24. The apparatus as defined in claim 22, wherein:
said conveyor is arranged to form an angle with respect to said path of travel.

25. The apparatus as defined in claim 22, wherein:
said printed products moving along said path of travel each have a leading edge;
said position changing means including abutment means projecting into the path of travel of said printed products as they are supplied to said conveyor; and
said leading edges of said printed products abutting said abutment means.

26. The apparatus as defined in claim 21, wherein:
said imbricated formation defines a longitudinal axis extending in a predetermined conveying direction;
said inverting means comprise deflecting means defining a transverse axis and serving to deflect said imbricated formation about said transverse axis; and
said transverse axis extending substantially horizontally and transversely relative to said predetermined conveying direction.

27. The apparatus as defined in claim 26, wherein:
said deflecting means comprise a deflecting drum rotatable about said transverse axis and an endless revolving support band extending about the circumference of said deflecting drum at a distance therefrom in order to define together with said deflecting drum a conveying gap through which passes said imbricated formation; and
said imbricated formation entering said conveying gap in a first conveying direction and leaving said conveying gap in a second conveying direction extending opposite to said first conveying direction.

28. An apparatus for processing flat products, especially printed products, arriving in a imbricated formation, comprising:

a wind-up station for winding up the flat products to form a product package for storing the flat products and an unwinding station for unwinding the flat products from said product package to form an imbricated formation;

inverting means arranged subsequent to said unwinding station for receiving and inverting the imbricated formation such that the imbricated formation is turned upside down;

position changing means arranged subsequent to said inverting means for receiving and repositioning individual products of the flat products within the imbricated formation into a different position such that edges of said individual products which are leading become trailing;

said flat products moving along a predetermined path of travel and following inverting of the imbricated formation by the inverting means possessing a first conveying direction;

said position changing means including a conveyor arranged below said path of travel;

said conveyor defining a second conveying direction deviating from said first conveying direction;

said second conveying direction running opposite to said first conveying direction;

said imbricated formation defines a longitudinal axis extending in a predetermined conveying direction;

said inverting means comprising deflecting means defining a transverse axis and serving to deflect said imbricated formation about said transverse axis;

said transverse axis extending substantially horizontally and transversely relative to said predetermined conveying direction;

said deflecting means comprising a deflecting drum rotatable about said transverse axis and an endless revolving support band extending about the circumference of said deflecting drum at a distance therefrom in order to define together with said deflecting drum a conveying gap through which passes said imbricated formation; and said imbricated formation entering said conveying gap in a first conveyance direction and leaving said conveying gap in a second conveyance direction extending opposite to said first conveyance direction.

29. In an apparatus for processing flat products especially printed products, arriving in an arriving imbricated formation, the apparatus including means for winding the imbricated products up to form a product package for storage and means for unwinding the products from the product package to form an unwound imbricated formation for further processing, the improvement comprising means for retaining in the unwound imbricated formation the product configuration of the arriving imbricated formation, in terms of mutual positions of the individual products and positions of leading edges of the products viewed in a conveying direction of the arriving imbricated formation, said means for retaining comprising means for changing the position of individual products of the flat products within one of said imbricated formations such that edges of said individual products which are leading become trailing, and means for inverting one of the imbricated formations for turning the products upside down.

30. Apparatus as claimed in claim 29 wherein the means for changing the position of individual products and the means for inverting said one of the imbricated formations are separated by the means for winding and the means for unwinding.

* * * * *